US012790561B2

(12) United States Patent
Tanaka et al.

(10) Patent No.: US 12,790,561 B2
(45) Date of Patent: Nov. 10, 2026

(54) LOW ASH LUBRICATING OIL COMPOSITION

(71) Applicants: CHEVRON JAPAN LTD., Tokyo (JP); CHEVRON ORONITE COMPANY LLC, San Ramon, CA (US)

(72) Inventors: Isao Tanaka, Makinohara City (JP); Kyosuke Aoyama, Omaezaki (JP); Ian Elliott, Vacaville, CA (US)

(73) Assignees: Chevron Japan Ltd., Tokyo (JP); Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 18/557,316

(22) PCT Filed: May 20, 2022

(86) PCT No.: PCT/IB2022/054715
§ 371 (c)(1),
(2) Date: Oct. 26, 2023

(87) PCT Pub. No.: WO2022/243947
PCT Pub. Date: Nov. 24, 2022

(65) Prior Publication Data

US 2024/0376396 A1 Nov. 14, 2024

Related U.S. Application Data

(60) Provisional application No. 63/191,005, filed on May 20, 2021.

(51) Int. Cl.

| | |
|---|---|
| ***C10M 169/04*** | (2006.01) |
| ***C10M 133/44*** | (2006.01) |
| ***C10M 135/10*** | (2006.01) |
| ***C10M 137/10*** | (2006.01) |
| ***C10M 141/10*** | (2006.01) |
| ***C10M 159/00*** | (2006.01) |
| ***C10M 163/00*** | (2006.01) |
| *C10N 30/00* | (2006.01) |
| *C10N 30/02* | (2006.01) |
| *C10N 30/04* | (2006.01) |
| *C10N 30/10* | (2006.01) |
| *C10N 40/25* | (2006.01) |

(52) U.S. Cl.
CPC ..... *C10M 169/045* (2013.01); *C10M 133/44* (2013.01); *C10M 135/10* (2013.01); *C10M 137/10* (2013.01); *C10M 141/10* (2013.01); *C10M 159/00* (2013.01); *C10M 163/00* (2013.01); *C10M 2203/003* (2013.01); *C10M 2219/046* (2013.01); *C10M 2223/045* (2013.01); *C10M 2227/09* (2013.01); *C10N 2030/02* (2013.01); *C10N 2030/04* (2013.01); *C10N 2030/10* (2013.01); *C10N 2030/45* (2020.05); *C10N 2030/52* (2020.05); *C10N 2040/25* (2013.01)

(58) Field of Classification Search
CPC ..... C10M 169/045; C10M 133/44; C10M 135/10; C10M 137/10; C10M 141/10; C10M 159/00; C10M 163/00; C10M 2203/003; C10M 2219/046; C10M 2223/045; C10M 2227/09; C10N 2030/02; C10N 2030/04; C10N 2030/10; C10N 2030/45; C10N 2030/52; C10N 2040/25
See application file for complete search history.

(56) References Cited

U.S. PATENT DOCUMENTS

| | | | |
|---|---|---|---|
| 3,172,892 | A | 3/1965 | La Suer et al. |
| 3,219,666 | A | 11/1965 | Norman et al. |
| 3,272,746 | A | 9/1966 | Suer |
| 3,356,702 | A | 12/1967 | Farmer |
| 4,098,705 | A | 7/1978 | Sakurai |
| 4,259,194 | A | 3/1981 | Devries |
| 4,259,195 | A | 3/1981 | King |
| 4,265,773 | A | 5/1981 | Devries |
| 4,265,843 | A | 5/1981 | Dias |
| 4,283,295 | A | 8/1981 | Devries |
| 4,285,822 | A | 8/1981 | Devries |
| 4,727,387 | A | 2/1988 | Israely |
| 4,889,647 | A | 12/1989 | Rowan |

(Continued)

FOREIGN PATENT DOCUMENTS

| | | | |
|---|---|---|---|
| CN | 1400295 | A | 3/2003 |
| CN | 111615549 | A | 9/2020 |

(Continued)

OTHER PUBLICATIONS

International Search Report, issued on Jul. 25, 2022, during the prosecution of International Application No. PCT/IB2022/054715.

(Continued)

*Primary Examiner* — Ellen M McAvoy
(74) *Attorney, Agent, or Firm* — Michael Sungjoon Pio

(57) ABSTRACT

A lubricating oil composition is provided. The composition includes major amount of an oil of lubricating viscosity, or more alkaline earth metal detergent, one or more nitrogen-containing dispersant, and up to about 0.10 wt % of zinc from zinc dithiophosphate. The lubricating oil composition has sulfur content of up to 0.10 wt %, sulfated ash content of up to 0.30 wt %, and the ratio of total nitrogen concentration to total alkaline earth metal concentration from the one or more alkaline earth metal detergent is about 20 or greater.

15 Claims, No Drawings

(56) References Cited

U.S. PATENT DOCUMENTS

| | | | | |
|---|---|---|---|---|
| 5,631,213 | A | 5/1997 | Tanaka | |
| 5,650,381 | A | 7/1997 | Gatto | |
| 5,888,945 | A | 3/1999 | Stiefel | |
| 6,010,987 | A | 1/2000 | Stiefel | |
| 6,174,842 | B1 | 1/2001 | Gatto | |
| RE37,363 | E | 9/2001 | Gatto | |
| 6,372,696 | B1 | 4/2002 | Tipton | |
| 6,569,818 | B2 * | 5/2003 | Nakazato | C10M 169/045 508/378 |
| 6,806,241 | B2 | 10/2004 | Karol | |
| RE38,929 | E | 1/2006 | Gatto | |
| RE40,595 | E | 12/2008 | Gatto | |
| 8,076,275 | B2 | 12/2011 | Ruhe, Jr. | |
| 8,841,243 | B2 * | 9/2014 | Tobias | C10M 163/00 508/390 |
| 2002/0019320 | A1 * | 2/2002 | Nakazato | C10M 169/048 508/159 |
| 2003/0216266 | A1 * | 11/2003 | Hirano | C10M 163/00 508/378 |
| 2008/0076686 | A1 * | 3/2008 | Nakazato | C10M 169/045 508/545 |
| 2009/0005278 | A1 * | 1/2009 | Takeuchi | C10M 169/04 508/371 |
| 2012/0118258 | A1 * | 5/2012 | Takeuchi | C10M 163/00 508/369 |
| 2013/0085089 | A1 * | 4/2013 | Takeuchi | C10M 163/00 508/365 |
| 2014/0187453 | A1 * | 7/2014 | Umehara | C10M 141/12 508/186 |
| 2019/0241828 | A1 * | 8/2019 | Oki | C10M 157/10 |
| 2020/0157460 | A1 | 5/2020 | Kubo et al. | |
| 2021/0371767 | A1 * | 12/2021 | Shimizu | C10M 141/10 |
| 2022/0127545 | A1 * | 4/2022 | Van Dam | C10M 171/02 |
| 2022/0169946 | A1 * | 6/2022 | Kusumoto | C10M 133/44 |
| 2022/0186137 | A1 * | 6/2022 | Utaka | C10M 169/04 |

FOREIGN PATENT DOCUMENTS

| | | | |
|---|---|---|---|
| JP | 2003327987 | A | 11/2003 |
| JP | 2020164746 | A | 10/2020 |
| WO | 2020203784 | | 10/2020 |
| WO | 2022243947 | W | 11/2022 |

OTHER PUBLICATIONS

Written Opinion of the International Searching Authority, issued on Jul. 25, 2022, during the prosecution of International Application No. PCT/IB2022/054715.

* cited by examiner

LOW ASH LUBRICATING OIL COMPOSITION

TECHNICAL FIELD

This disclosure relates to lubricating oil composition that produces low sulfated ash and method for using the same.

BACKGROUND

Exhaust after-treatment devices, equipped on internal combustion engines to comply with emission regulations, have proven to be sensitive to the combustion byproducts of fuel and lubricant used in the engine. In particular, certain types of devices are sensitive to sulfated ash resulting from the combustion of fuel and lubricant. In order to ensure the durability of the different types of after-treatment devices, lubricants are being developed that produce relatively low levels of sulfated ash.

One approach to limiting sulfated ash is to reduce the amount of detergents in lubricants. In particular, detergents are often overbased by metal base. However, reducing detergents can lead to other issues such as deposit formation which may be difficult to overcome.

SUMMARY

In one aspect, there is provided a lubricating oil composition comprising: a) major amount of an oil of lubricating viscosity; b) one or more alkaline earth metal detergent, c) one or more nitrogen-containing dispersant; and d) up to about 0.10 wt % of zinc from zinc dithiophosphate; wherein the lubricating oil composition has sulfur content of up to about 0.10 wt % and sulfated ash content of up to about 0.30 wt % and the ratio of total nitrogen concentration to total alkaline earth metal concentration from the one or more alkaline earth metal detergent is about 20 or greater.

In another aspect, there is provided a method of reducing deposit in an internal combustion engine comprising: operating the internal combustion engine with a lubricating oil composition comprising a) major amount of an oil of lubricating viscosity; b) one or more alkaline earth metal detergent, c) one or more nitrogen-containing dispersant; and d) up to about 0.10 wt % of zinc from zinc dithiophosphate; wherein the lubricating oil composition has sulfur content of up to about 0.10 wt %, sulfated ash content of up to about 0.30 wt % and the ratio of total nitrogen concentration to total alkaline earth metal concentration from the one or more alkaline earth metal detergent is about 20 or greater.

DETAILED DESCRIPTION

In this specification, the following words and expressions, if and when used, have the meanings ascribed below.

The terms "oil soluble" means that for a given additive, the amount needed to provide the desired level of activity or performance can be incorporated by being dissolved, dispersed or suspended in an oil of lubricating viscosity. Usually, this means that at least 0.001% by weight of the additive can be incorporated in a lubricating oil composition.

A "minor amount" means less than 50 wt % of a composition, expressed in respect of the stated additive and in respect of the total weight of the composition, reckoned as active ingredient of the additive.

An "engine" or a "combustion engine" is a heat engine where the combustion of fuel occurs in a combustion chamber. An "internal combustion engine" is a heat engine where the combustion of fuel occurs in a confined space ("combustion chamber"). A "spark ignition engine" is a heat engine where the combustion is ignited by a spark, usually from a spark plug. This is contrast to a "compression-ignition engine," typically a diesel engine, where the heat generated from compression together with injection of fuel is sufficient to initiate combustion without an external spark.

It has now been found that the low ash lubricating oil compositions of this disclosure can provide key performance benefits over at least some conventional lubricating oil compositions. These performance benefits include lower production of sulfated ash, deposit control, better lubricity, detergency, and thermal and/or oxidative stability.

The low ash lubricating oil composition generally includes 1) a major amount of an oil of lubricating viscosity, 2) one or more alkaline earth metal detergent, 3) one or more nitrogen-containing dispersant, and 4) up to about 0.10 wt % of zinc from zinc dithiophosphate.

In some embodiments, the ratio of total nitrogen concentration to total alkaline earth metal concentration from the one or more alkaline earth metal detergent is about 20 or greater. The lubricating oil composition has sulfur content of about 0.10 wt % or less, and ash content of about 0.30 wt % or less as determined by ASTM D874.

The lubricating oil compositions of the present disclosure may have a total base number of about 5.0 mg KOH/g or less, such as about 4.75 mg KOH/g or less, about 4.5 mg KOH/g or less, about 4.25 mg KOH/g or less, about 4 mg KOH/g or less, about 3.75 mg KOH/g or less, about 3.5 mg KOH/g or less, about 3.25 mg KOH/g or less, and about 3.0 mg KOH/g or less. In some embodiments, the total base number may range from about 0.5 mg KOH/g to about 5.0 mg KOH/g, such as from about 0.75 to about 4.75 mg KOH/g, about 1.0 to about 4.5 mg KOH/g, about 1.25 to about 4.25 mg KOH/g, about 1.5 to about 4 mg KOH/g, about 1.75 to about 3.75 mg KOH/g, and about 2.0 to about 3.5 mg KOH/g.

The lubricating oil composition of the present invention can be used to lubricate an internal combustion engine including an engine fueled by liquid hydrocarbon fuel, hydrogen gas fuel, natural gas liquefied petroleum gas (LPG), compressed natural gas (CNG), or a mixture thereof.

Detergent

The lubricating oil composition of the present invention includes metal detergents. Particularly useful detergents include oil-soluble sulfonates (e.g., alkaryl sulfonates), hydroxyaromatic carboxylates (e.g., salicylates, alkylhydroxybenzoates, etc.), and phenates. These detergents typically contain one or more alkali metal such as sodium and/or alkaline earth metals such as calcium and magnesium.

Due to the low ash nature of the lubricating oil composition, the amount of detergent present is important. In some embodiments, the total alkaline earth metal concentration is about 0.00010 to about 0.025 wt %, such as about 0.00050 to about 0.025 wt %, about 0.0010 to about 0.020 wt %, about 0.0025 to about 0.020 wt %, about 0.0050 to about 0.020 wt %, and about 0.0075 to about 0.020 wt %, based on total lubricating oil composition.

The metal detergent of the present invention may have a wide range of TBN values. For example, the metal detergent may be a neutral detergent, low overbased detergent, medium overbased detergent, high overbased detergent, and so forth.

In one aspect, the detergent may include one or more metal salts of sulfonate. Sulfonates may be prepared from sulfonic acids which are often obtained by the sulfonation of alkyl-substituted aromatic compounds such as those obtained from the fractionation of petroleum or by the alkylation of aromatic compounds. Examples include those obtained by alkylating benzene, toluene, xylene, naphthalene, Biphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms, preferably about 16 to about 30 carbon atoms, and more preferably 20-24 carbon atoms per alkyl substituted aromatic moiety.

Metal detergents are generally produced by carbonating a mixture of hydrocarbons, detergent acid (e.g., sulfonic acid), metal oxide or hydroxides (e.g., calcium oxide or calcium hydroxide) and promoters such as xylene, methanol and water. During a carbonation step, calcium oxide or hydroxide can react with the gaseous carbon dioxide to form calcium carbonate. As an illustrative example, the synthesis of calcium sulfonate detergent involves neutralization of sulfonic acid with an excess of CaO or $Ca(OH)_2$ to form the sulfonate.

According to an embodiment, the detergent may include one or more metal salts of hydroxyaromatic carboxylate. Suitable hydroxyaromatic compounds include mononuclear monohydroxy and polyhydroxy aromatic hydrocarbons having 1 to 4, and preferably 1 to 3 hydroxyl groups. Suitable hydroxyaromatic compounds include phenol, catechol, resorcinol, hydroquinone, pyrogallol, cresol, and the like.

According to an embodiment, the detergent may include one or more metal salts of phenate. Suitable phenates can be prepared by reacting an alkaline earth metal hydroxide or oxide (e.g., CaO, $Ca(OH)_2$, MgO, or $Mg(OH)_2$) with an alkyl phenol or sulfurized alkylphenol. Useful alkyl groups include straight or branched chain C1 to C30 (e.g., C4 to C20) alkyl groups, or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched chain. When a non-sulfurized alkylphenol is used, the sulfurized product may be obtained by methods well known in the art. These methods include heating a mixture of alkylphenol and sulfurizing agent (e.g., elemental sulfur, sulfur halides such as sulfur dichloride, and the like) and then reacting the sulfurized phenol with an alkaline earth metal base.

Nitrogen-Containing Dispersant

The lubricating oil composition of the present invention includes nitrogen-containing dispersants. These include polyalkenyl succinimide dispersants such as those described herein. In general, the nitrogen content from the nitrogen-containing dispersant based on the lubricating oil composition is from about 0.010 wt % to about 0.30 wt % such as from about 0.050 to about 0.25 wt %, about 0.050 to about 0.20 wt %, and about 0.050 to about 0.15 wt %.

In one embodiment, a polyalkenyl bis-succinimide can be obtained by reacting a polyalkenyl-substituted succinic anhydride below (I)

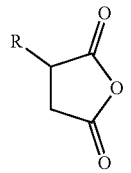

wherein R is a polyalkenyl substituent is derived from a polyalkene group having a number average molecular weight of from about 500 to about 3000, with a polyamine. In one embodiment, R is a polyalkenyl substituent derived from a polyalkene group having a number average molecular weight of from about 1000 to about 2500. In one embodiment, R is a polyisobutenyl substituent derived from a polyisobutene having a number average molecular weight of from about 500 to about 3000. In another embodiment, R is a polyisobutenyl substituent derived from a polyisobutene having a number average molecular weight of from about 1000 to about 2500.

Suitable polyamines for use in preparing the bis-succinimide dispersants include polyalkylene polyamines. Such polyalkylene polyamines will typically contain about 2 to about 12 nitrogen atoms and about 2 to 24 carbon atoms. Particularly suitable polyalkylene polyamines are those having the formula: $H_2N$—(R'NH)x-H wherein R' is a straight- or branched-chain alkylene group having 2 or 3 carbon atoms and x is 1 to 9. Representative examples of suitable polyalkylene polyamines include ethylenediamine, diethylenetriamine, triethylenetetraamine, tetraethylenepentamine, pentaethylene hexamine, and heavy polyamines (e.g., Ethyleneamine E-100, available from Huntsman Company).

Generally, the polyalkenyl-substituted succinic anhydride is reacted with the polyamine at a temperature of about 130° C. to about 220° C. (e.g., 145° C. to 175° C.). The reaction can be carried out under an inert atmosphere, such as nitrogen or argon. Generally, a suitable molar charge of polyamine to polyalkenyl-substituted succinic anhydride is from about 0.35:1 to about 0.6:1 (e.g., 0.4:1 to 0.5:1). As used herein, the β "molar charge of polyamine to polyalkenyl-substituted succinic anhydride" means the ratio of the number of moles of polyamine to the number of succinic groups in the succinic anhydride reactant.

One class of suitable polyalkenyl succinimides may be represented by the following:

(II)

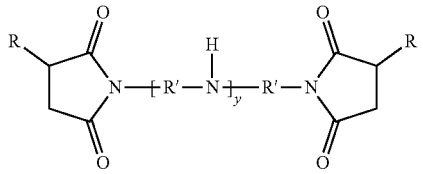

wherein R and R' are as described herein above and y is 1 to 11.

Post-Treatment of Polyalkenyl Succinimide

In some embodiments, the succinimide dispersant may be post-treated by a reactive boron compound or organic carbonate.

Suitable boron compounds that can be used as a source of boron include, for example, boric acid, a boric acid salt, a boric acid ester, and the like. Representative examples of a boric acid include orthoboric acid, metaboric acid, paraboric acid, and the like. Representative examples of a boric acid salt include ammonium borates, such as ammonium metaborate, ammonium tetraborate, ammonium pentaborate, ammonium octaborate, and the like. Representative examples of a boric acid ester include monomethyl borate, dimethyl borate, trimethyl borate, monoethyl borate, diethyl borate, triethyl borate, monopropyl borate, dipropyl borate, tripropyl borate, monobutyl borate, dibutyl borate, tributyl borate, and the like.

Suitable organic carbonates include, for example, cyclic carbonates such as 1,3-dioxolan-2-one (ethylene carbonate); 4-methyl-1,3-dioxolan-2-one(propylene carbonate); 4-ethyl-1,3-dioxolan-2-one(butylene carbonate); 4-hydroxymethyl-1,3-dioxolan-2-one; 4,5-dimethyl-1,3-dioxolan-2-one; 4-ethyl-1,3-dioxolan-2-one; 4,4-dimethyl-1,3-dioxolan-2-one; 4-methyl-5-ethyl-1,3-dioxolan-2-one; 4,5-diethyl-1,3-dioxolan-2-one; 4,4-diethyl-1,3-dioxolan-2-one; 1,3-dioxan-2-one; 4,4-dimethyl-1,3-dioxan-2-one; 5,5-dimethyl-1,3-dioxan-2-one; 5,5-dihydroxymethyl-1,3-dioxan-2-one; 5-methyl-1,3-dioxan-2-one; 4-methyl-1,3-dioxan-2-one; 5-hydroxy-1,3-dioxan-2-one; 5-hydroxymethyl-5-methyl-1,3-dioxan-2-one; 5,5-diethyl-1,3-dioxan-2-one; 5-methyl-5-propyl-1,3-dioxan-2-one; 4,6-dimethyl-1,3-dioxan-2-one; 4,4,6-trimethyl-1,3-dioxan-2-one and spiro[1,3-oxa-2-cyclohexanone-5,5'-1',3'-oxa-2'-cyclohexanone]. Other suitable cyclic carbonates may be prepared from saccharides such as sorbitol, glucose, fructose, galactose and the like and from vicinal diols prepared from $C_1$ to $C_{30}$ olefins by methods known in the art.

Anti-Wear Agent

The lubricating oil composition disclosed herein can comprise one or more anti-wear agents which reduce wear of metal parts. Suitable anti-wear agents include dihydrocarbyl dithiophosphate metal salts such as zinc dihydrocarbyl dithiophosphates (ZDDP):

$$Zn[S—P(=S)(OR^1)(OR^2)]_2$$

wherein $R^1$ and $R^2$ may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as $R^1$ and $R^2$ groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e., $R'+R^2$) will be at least 5. The zinc dihydrocarbyl dithiophosphate can therefore comprise zinc dialkyl dithiophosphates. The zinc dialkyl dithiophosphate is a primary, secondary zinc dialkyl dithiophosphate, or a combination thereof. In general, the ZDDP may be present in an amount such that Zn from the ZDDP is present in about 0.010 to about 0.10 wt % such as from about 0.010 to about 0.075 wt %, about 0.020 to about 0.050 wt %, about 0.025 to about 0.050 wt % based on the lubricating oil corn position.

Molybdenum Containing Compound

The molybdenum containing compound is an organomolybdenum compound comprising molybdenum, carbon and hydrogen atoms, but may also contain sulfur, phosphorus, nitrogen and/or oxygen atoms. Suitable organomolybdenum compounds include molybdenum dithiocarbamates, molybdenum dithiophosphates, and various organic molybdenum complexes such as molybdenum carboxylates, molybdenum esters, molybdenum amines, molybdenum amides, which can be obtained by reacting molybdenum oxide or ammonium molybdates with fats, glycerides or fatty acids, or fatty acid derivatives (e.g., esters, amines, amides). The term "fatty" means a carbon chain having 10 to 22 carbon atoms, typically a straight carbon chain.

Molybdenum containing compounds may be present in about 0.10 to about 4.0 wt % such as 0.25 to 3.75 wt %, 0.5 to 3.5 wt %, 0.75 to 3.25 wt %, 1.0 to 3.0 wt %, 1.25 to 2.75 wt %, 1.5 to 2.5 wt %. In one embodiment, the molybdenum containing compound is free of sulfur.

Suitable molybdenum dithiocarbamates include any molybdenum dithiocarbamate which can be used as an additive for lubricating oils. One class of molybdenum dithiocarbamates for use herein is represented by the following:

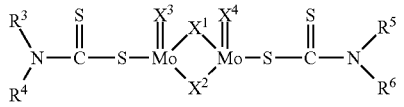

wherein $R^3$, $R^4$, $R^5$, and $R^6$ are each independently hydrogen or a hydrocarbon group including, by way of example, alkyl groups, alkenyl groups, aryl groups, cycloalkyl groups and cycloalkenyl groups, and $X^1$, $X^2$, $X^3$ and $X^4$ are each independently sulfur or oxygen.

Suitable alkyl groups include, but are not limited to, methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, decyl, secondary decyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, icosyl, docosyl, tetracosyl, triacontyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched-isostearyl and the like.

Suitable alkenyl groups include, but are not limited to, vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleyl and the like.

Suitable aryl groups include, but are not limited to, phenyl, tolyl, xylyl, cumenyl, mesityl, benzyl, phenethyl, styryl, cinnamyl, benzhydryl, trityl, ethylphenyl, propylphenyl, butyl phenyl, pentylphenyl, hexyl phenyl, heptylphenyl, octylphenyl, nonyl phenyl, decyl phenyl, undecyl phenyl, dodecyl phenyl, biphenyl, benzylphenyl, styrenated phenyl, p-cumylphenyl, alpha-naphthyl, beta-naphthyl groups and the like.

Suitable cycloalkyl groups and cycloalkenyl groups include, but are not limited to, cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like.

In an embodiment, $X^1$ to $X^4$ are independently selected from sulfur or oxygen atom, and all of $X^1$ to $X^4$ may be a sulfur atom or an oxygen atom, or a mixture of sulfur atoms and oxygen atoms. In consideration of balance between friction reducing effect and corrosivity, the molar ratio (ratio of numbers) of sulfur atom(s)/oxygen atom(s) should particularly preferably be in the range from about ⅓ to about 3/1.

Some of the oil-soluble or dispersed oil-stable molybdenum compounds are commercially available. For example, products where $X^1$ and $X^2$ are O, $X^3$ and $X^4$ are S, and where $R^3$ to $R^6$ are $C_{13}H_{27}$ aliphatic hydrocarbyl groups and where the molybdenum is in oxidation state V are sold under the trademarks Molyvan 807 and Molyvan 822 as antioxidants and friction reducing additives by R. T. Vanderbilt Company Inc. (Norwalk, Conn. USA). These molybdenum compounds may be prepared by the methods described in U.S. Pat. No. 3,356,702 wherein $MoO_3$ is converted to soluble molybdate by dissolving in alkali metal hydroxide solution, neutralized by the addition of acid followed by the addition of a secondary amine and carbon disulfide. In another aspect, $X^1$ to $X^4$ are 0 or S may be prepared by a number of methods known in the art such as, for example, U.S. Pat. Nos. 4,098,705 and 5,631,213.

Generally, the sulfurized oxymolybdenum dithiocarbamates can be prepared by reacting molybdenum trioxide or a molybdate with an alkali sulfide or an alkali hydrosulfide, and subsequently adding carbon disulfide and a secondary amine to the reaction mixture and reacting the resultant mixture at an adequate temperature. To prepare the asymmetric sulfurized oxymolybdenum dithiocarbamates, the use of a secondary amine having different hydrocarbon groups or the use of two or more different secondary amines in the above process is sufficient. The symmetric sulfurized oxymolybdenum dithiocarbamates can also be prepared in a similar manner, but with the use of only one secondary amine.

Examples of suitable molybdenum dithiocarbamate compounds include, but are not limited to, sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenum dioctyldithiocarbamate, sulfurized molybdenum didecyldithiocarbamate, sulfurized molybdenum didodecyldithiocarbamate, sulfurized molybdenum ditridecyldithiocarbamate, sulfurized molybdenum di(butylphenyl)dithiocarbamate, sulfurized molybdenum di(nonylphenyl)dithiocarbamate, sulfurized oxymolybdenum diethyldithiocarbamate, sulfurized oxymolybdenum di propyldithiocarbamate, sulfurized oxymolybdenum di butyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum ditridecyldithiocarbamate, sulfurized oxymolybdenum di(butylphenyl)dithiocarbamate, sulfurized oxymolybdenum di(nonylphenyl)dithiocarbamate, all of which the alkyl groups may be straight-chain or branched, and the like and mixtures thereof.

Trinuclear molybdenum dialkyldithiocarbamates are also known in the art, as taught by U.S. Pat. Nos. 5,888,945 and 6,010,987, herein incorporated by reference. Trinuclear molybdenum compounds preferably those having the formulas $Mo_3S_4(dtc)_4$ and $Mo_3S_7(dtc)_4$ and mixtures thereof wherein dtc represents independently selected diorganodithiocarbamate ligands containing independently selected organo groups and wherein the ligands have a sufficient number of carbon atoms among all the organo groups of the compound's ligands are present to render the compound soluble or dispersible in the lubricating oil.

Molybdate esters prepared by methods disclosed in U.S. Pat. Nos. 4,889,647 and 6,806,241 B2. A commercial example is MOLYVAN® 855 additive, which is manufactured by R. T. Vanderbilt Company, Inc.

Molybdenum dithiophosphate (MoDTP) is an organomolybdenum compound represented by the following:

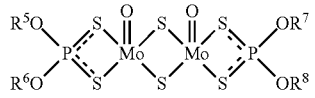

wherein $R^5$, $R^6$, $R^7$ and $R^8$ are independently of each other, linear or branched alkyl groups having from 4 to 18 carbon atoms (e.g., 8 to 13 carbon atoms).

Molybdenum carboxylates are described in U.S. Pat. RE 38,929, and U.S. Pat. No. 6,174,842 and thus are incorporated herein by reference. Molybdenum carboxylates can be derived from any oil soluble carboxylic acid. Typical carboxylic acids include naphthenic acid, 2-ethylhexanoic acid, and linolenic acid. Suitable examples of molybdenum compounds include commercial materials sold under the trade names such as Molyvan® 822, Molyvan® A, Molyvan® 2000. Molyvan® 807 and Molyvan® 855T from R. T. Vanderbilt Co., Ltd., and Sakura-Lube™ S-165, 5-200, S-300, S-310G, 5-525, S-600, S-700, and S-710 available from Adeka Corporation, and mixtures thereof. Suitable molybdenum components are described in U.S. Pat. Nos. 5,650,381; RE 37,363 E1; RE 38,929 E1; and RE 40,595 E1, incorporated herein by reference in their entireties Ammonium molybdates are prepared by the acid base reaction of acidic molybdenum source such as molybdenum trioxide, molybdic acid, and ammonium molybdate and ammonium thiomolybdates with oil-soluble amines and optionally in presence of sulfur sources such sulfur, inorganic sulfides and polysulfides, and carbons disulfide to name few. The preferred aminic compounds are polyamine dispersants that are commonly used engine oil compositions. Examples of such dispersants are succinimides and Mannich type. References to these preparations are U.S. Pat. Nos. 4,259,194, 4,259,195, 4,265,773, 4,265,843, 4,727,387, 4,283,295, and 4,285,822.

Molybdenum Succinimide

In one embodiment, the molybdenum amine is a molybdenum-succinimide complex. Suitable molybdenum-succinimide complexes are described, for example, in U.S. Pat. No. 8,076,275. These complexes are prepared by a process comprising reacting an acidic molybdenum compound with an alkyl or alkenyl succinimide of a polyamine below:

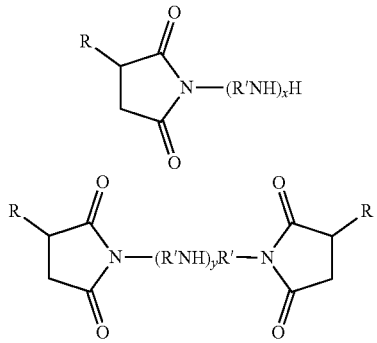

wherein R is a $C_{24}$ to $C_{350}$ (e.g., $C_{70}$ to $C_{128}$) alkyl or alkenyl group; R' is a straight or branched-chain alkylene group having 2 to 3 carbon atoms; x is 1 to 11; and y is 1 to 11.

The molybdenum compounds used to prepare the molybdenum-succinimide complex are acidic molybdenum compounds or salts of acidic molybdenum compounds. By "acidic" is meant that the molybdenum compounds will react with a basic nitrogen compound as measured by ASTM D664 or D2896. Generally, the acidic molybdenum compounds are hexavalent Representative examples of suitable molybdenum compounds include molybdenum trioxide, molybdic acid, ammonium molybdate, sodium molybdate, potassium molybdate and other alkaline metal molybdates and other molybdenum salts such as hydrogen salts, (e.g., hydrogen sodium molybdate), $MOOCl_4$, $MoO_2Br_2$, $Mo_2O_3Cl_6$ and the like.

The succinimides that can be used to prepare the molybdenum-succinimide complex are disclosed in numerous references and are well known in the art. Certain fundamental types of succinimides and the related materials encompassed by the term of art "succinimide" are taught in U.S. Pat. Nos. 3,172,892; 3,219,666; and 3,272,746. The term "succinimide" is understood in the art to include many of the amide, imide, and amidine species which may also be formed. The predominant product however is a succinimide and this term has been generally accepted as meaning the product of a reaction of an alkyl or alkenyl substituted succinic acid or anhydride with a nitrogen-containing compound. Preferred succinimides are those prepared by reacting a polyisobutenyl succinic anhydride of about 70 to 128 carbon atoms with a polyamine.

Preferred polyamines may have 2 to 60 carbon atoms and from 2 to 12 nitrogen atoms per molecule. Particularly preferred amines include polyalkyleneamines represented by the formula:

$$NH_2(CH_2)_n—(NH(CH_2)_n)_m—NH_2$$

wherein n is 2 to 3 and m is 0 to 10. Illustrative examples include ethylene diamine, diethylene triamine, triethylene tetramine, tetraethylene pentamine, tetrapropylene pentamine, pentaethylene hexamine and the like, as well as the commercially available mixtures of such polyamines.

The molybdenum-succinimide complex may be post-treated with a sulfur source at a suitable pressure and a temperature not to exceed 120° C. to provide a sulfurized molybdenum-succinimide complex. The sulfurization step may be carried out for a period of from about 0.5 to 5 hours (e.g., 0.5 to 2 hours). Suitable sources of sulfur include elemental sulfur, hydrogen sulfide, phosphorus pentasulfide, organic polysulfides of formula $R_2S_x$ where R is hydrocarbyl (e.g., $C_1$ to $C_{10}$ alkyl) and x is at least 3, $C_1$ to $C_{10}$ mercaptans, inorganic sulfides and polysulfides, thioacetamide, and thiourea.

Friction Modifier

The lubricating oil composition of the present disclosure can contain friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, dithiocarbamates (e.g., DTC), alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof. Typical concentrations of friction modifiers may be from about 0.05 to about 0.50 wt % such as from about 0.10 to about 0.50 wt %, and about 0.050 to about 0.10 wt %.

Antioxidants

The lubricating oil composition disclosed herein can comprise one or more antioxidants. Antioxidants reduce the tendency of mineral oils during to deteriorate during service. Oxidative deterioration can be evidenced by sludge in the lubricant, varnish-like deposits on the metal surfaces, and by viscosity growth. Suitable antioxidants include hindered phenols, aromatic amines, and sulfurized alkylphenols and alkali and alkaline earth metals salts thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol; 4-methyl-2,6-di-tert-butylphenol; 4-ethyl-2,6-di-tert-butyl phenol; 4-propyl-2,6-di-tert-butylphenol; 4-butyl-2,6-di-tert-butylphenol; and 4-dodecyl-2,6-di-tert-butylphenol. Other useful hindered phenol antioxidants include 2,6-di-alkyl-phenolic propionic ester derivatives such as IRGANOX® L-135 from Ciba and bis-phenolic antioxidants such as 4,4'-bis(2,6-di-tert-butylphenol) and 4,4'-methylenebis(2,6-di-tert-butyl phenol).

Typical aromatic amine antioxidants have at least two aromatic groups attached directly to one amine nitrogen. Typical aromatic amine antioxidants have alkyl substituent groups of at least 6 carbon atoms. Particular examples of aromatic amine antioxidants useful herein include 4,4'-dioctyldiphenylamine, 4,4'-dinonyldiphenylamine, N-phenyl-1-naphthylamine, N-(4-tert-octyphenyl)-1-naphthylamine, and N-(4-octylphenyl)-1-naphthylamine. Antioxidants with amine groups can contribute to the overall nitrogen content. The amine antioxidant may contribute about 0.020 to about 0.10 wt % of nitrogen. In some embodiments, the total amount of antioxidants is about 1.5 to about 4.0 wt %, such as from 1.5 to 3.75 wt %, and 1.75 to 3.5 wt % based on total weight of the lubricating oil composition.

Oil of Lubricating Viscosity

The oil of lubricating viscosity (sometimes referred to as "base stock" or "base oil") is the primary liquid constituent of a lubricant, into which additives and possibly other oils are blended to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful as base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes); alkylbenzenes (e.g., dodecylbenzenes, tetradecylbenzenes, di nonyl benzenes, di(2-ethylhexyl)benzenes; polyphenols (e.g., biphenyls, terphenyls, alkylated polyphenols); and alkylated diphenyl ethers and alkylated Biphenyl sulfides and the derivatives, analogues and homologues thereof. Polymerized olefins can also be derived from bio-derived sources such as hydrocarbon terpenes such as myrcene, ocimene and farnesene which can also be co-polymerized with other olefins and further isomerized if desired.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Also, esters from bio-derived sources are also useful as synthetic oils.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfuro, wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt %, preferably greater than about 70 wt %, more preferably from about 80 to about 99.5 wt % and most preferably from about 85 to about 98 wt %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain additional viscosity modifiers or viscosity index improvers, e.g., comb-shaped polymethacrylate polymers/polyalkyl methacrylate polymers, olefinic copolymers, an ethylene-propylene copolymer or a styrene-butadiene copolymer; and the like and mixtures thereof.

As one skilled in the art would readily appreciate, the viscosity of the base oil is dependent upon the application. Generally, individually the base oils used as engine oils will have a kinematic viscosity range at 100° C. of about 4 cSt to about 8 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-30, 0W-40, 0W-50, 0W-60, 5W, 5W-16, 5W-20, 5W-30, 5W-40, 5W-50, 5W-60, 10W, 10W-20, 10W-30, 10W-40, 10W-50, 15W, 15W-20, 15W-30, 15W-40, 30,40 and the like. The lubricating oil composition also has a viscosity index of about 200 or less.

In general, the level of sulfur in the lubricating oil compositions of the present disclosure is less than or equal to about 0.10 wt %, based on the total weight of the lubricating oil composition, e.g., a level of sulfur of 0.010 wt % to 0.10 wt %, 0.010 to 0.090 wt %, 0.010 to 0.080 wt %, 0.010 to 0.070 wt %, 0.010 to 0.060 wt %, 0.010 to 0.050 wt %, 0.010 wt. % to 0.040 wt. %. In one embodiment the level of sulfur in the lubricating oil compositions of the present disclosure is less than or equal to about 0.10 wt %, less than or equal to about 0.090 wt %, less than or equal to about 0.080 wt %, less than or equal to about 0.070 wt %, less than or equal to about 0.060 wt %, less than or equal to about 0.050 wt % based on the total weight of the lubricating oil composition.

In one embodiment, the level of sulfated ash produced by the lubricating oil compositions of the present disclosure is less than or equal to about 0.30 wt. % as determined by ASTM D 874, e.g., a level of sulfated ash of about 0.01 to about 0.30 wt. % as determined by ASTM D 874. In one embodiment, the level of sulfated ash produced by the lubricating oil compositions of the present disclosure is less than or equal to about 0.30 wt %, less than or equal to about 0.25 wt %, less than or equal to about 0.20 wt %, or less than or equal to about 0.15 wt % as determined by ASTM D 874.

Lubricant Additives

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.010 to about 10 wt %.

EXAMPLES

The following non-limiting examples are provided.

Example 1

HOB Ca Sulfonate

SAE 5W-20 viscosity grade lubricating oil composition was prepared by blending the following components:

a) 1030 ppm, in terms of nitrogen content, of one or more nitrogen-containing dispersants
b) 2 mmol/kg of an overbased calcium sulfonate having a TBN of 410
c) 6 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.25 wt %.

Example 2

HOB Mg Sulfonate

SAE 5W-20 viscosity grade lubricating oil composition was prepared by blending the following components:

a) 1030 ppm, in terms of nitrogen content, of one or more nitrogen-containing dispersants
b) 2 mmol/kg of an overbased magnesium sulfonate having a TBN of 400
c) 6 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.24 wt %.

Example 3

Low Zn

SAE 5W-20 viscosity grade lubricating oil composition was prepared by blending the following components:

a) 1030 ppm, in terms of nitrogen content, of one or more nitrogen-containing dispersants
b) 2 mmol/kg of an overbased calcium sulfonate having a TBN of 410
c) 2 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.12 wt %.

Example 4

LOB

SAE 5W-20 viscosity grade lubricating oil composition was prepared by blending the following components:

a) 1030 ppm, in terms of nitrogen content, of one or more nitrogen-containing dispersants
b) 2 mmol/kg of a neutral calcium sulfonate having a TBN of 17
c) 6 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.25 wt %.

Comparative Example 1

High Ash

SAE 5W-20 viscosity grade lubricating oil composition was prepared by blending the following components:

a) 1030 ppm, in terms of nitrogen content, of one or more nitrogen-containing dispersants
b) 30 mmol/kg of an overbased calcium sulfonate having a TBN of 410
c) 6 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.52 wt %.

Comparative Example 2

High Zn

SAE 5W-20 viscosity grade lubricating oil composition was prepared by blending the following components:

a) 1030 ppm, in terms of nitrogen content, of one or more nitrogen-containing dispersants
b) 2 mmol/kg of an overbased calcium sulfonate having a TBN of 410
c) 18 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.50 wt %.

Comparative Example 3

Low Dispersant

AE 5W-20 viscosity grade lubricating oil composition was prepared by blending the following components:

a) 516 ppm, in terms of nitrogen content, of one or more nitrogen-containing dispersants
b) 2 mmol/kg of an overbased calcium sulfonate having a TBN of 410
c) 6 mmol/kg of a primary zinc dithiophosphate
d) 680 ppm, in terms of molybdenum content, of a molybdenum succinimide complex
e) 0.2 wt % of an ester-based friction modifier
f) 2.5 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.21 wt %.

Comparative Example 4

Low Antioxidant

SAE 5W-20 viscosity grade lubricating oil composition was prepared by blending the following components:

a) 1030 ppm, in terms of nitrogen content, of one or more nitrogen-containing dispersants
b) 30 mmol/kg of an overbased calcium sulfonate having a TBN of 410
c) 6 mmol/kg of a primary zinc dithiophosphate
d) 680 ppm, in terms of molybdenum content, of a molybdenum succinimide complex
e) 0.2 wt % of an ester-based friction modifier
f) 1.0 wt % total of one or more antioxidants
g) 2.5 wt % of a viscosity modifier The remainder of the lubricating oil composition includes a minor amount of foam inhibitor, pour point depressant, and a mixture of Group III base oil with a KV100 of 4 cSt and Group III base oil with KV 100 of 6 cSt in a 35:65 ratio in terms of base oil. The ash level of the finished oil was 0.25 wt %.

TABLE 2

| | Description | | | |
|---|---|---|---|---|
| | Ca Sul HOB | Mg Sul HOB | Low Zn | LOB |
| | Composition (wt %) | | | |
| | Ex. 1 | Ex. 2 | Ex. 3 | Ex. 4 |
| Antioxidant | 2.5 | 2.5 | 2.5 | 2.5 |
| Nitrogen (wt %) | 0.189 | 0.189 | 0.189 | 0.189 |
| Total Nitrogen/metal from detergent | 24 | 38 | 24 | 24 |
| Sulfated Ash (wt %) | 0.25 | 0.24 | 0.12 | 0.25 |
| Sulfur (wt %) | 0.081 | 0.089 | 0.030 | 0.089 |
| Zn from anti-wear agent (wt %) | 0.044 | 0.044 | 0.015 | 0.044 |
| Ca from detergent (wt %) | 0.0080 | — | 0.0080 | 0.0080 |
| Mg from detergent (wt %) | — | 0.0050 | — | — |
| Detergent type | HOB sulfonate (TBN 410) | HOB sulfonate (TBN 400) | HOB sulfonate (TBN 410) | Neutral sulfonate (TBN 17) |
| Viscosity Index | | | | |
| TBN by ASTM D2896 (mg KOH/g) | 4.65 | 4.65 | 4.65 | 4.50 |
| KV100 (cSt) | 8.0 | | 8.0 | |
| KV40 (cSt) | 43.6 | | 43.3 | |

TABLE 2-continued

| | Description | | | |
|---|---|---|---|---|
| | High Ash | High Zn | Low Disp | Low AO |
| | Composition (wt %) | | | |
| | Comp. Ex. 1 | Comp. Ex. 2 | Comp. Ex. 3 | Comp. Ex. 4 |
| Antioxidant (wt %) | 2.5 | 2.5 | 2.5 | 0 |
| Nitrogen (wt %) | 0.189 | 0.189 | 0.137 | 0.136 |
| Total Nitrogen/metal from detergent | 2 | 24 | 17 | 17 |
| Sulfated Ash (wt %) | 0.52 | 0.50 | 0.210 | 0.25 |
| Sulfur (wt %) | 0.093 | 0.231 | 0.081 | 0.080 |
| Zn from anti-wear agent (wt %) | 0.044 | 0.132 | 0.044 | 0.040 |
| Ca from detergent (wt %) | 0.12 | 0.0080 | 0.0080 | 0.0080 |
| Mg from detergent (wt %) | — | — | — | — |
| Detergent type | HOB sulfonate (TBN 410) | HOB sulfonate (TBN 410) | HOB sulfonate (TBN 410) | HOB sulfonate (TBN 410) |
| Viscosity Index | | | | |
| TBN by ASTM D2896 (mg KOH/g) | 7.63 | 4.65 | 3.68 | 2.62 |
| KV100 (cSt) | 8.2 | 8.1 | | |
| KV40 (cSt) | 44.4 | 44.1 | | |

Performance Tests

TEOST T-33

The TEOST 33 test (ASTM D6335) is a procedure for assessing the deposit forming tendencies of engine oils brought into contact with 500° C. turbocharger components. The TEOST 33 test used herein is described in D. W. Florkowski and T. W. Selby, "The Development of a Thermo-Oxidation Engine Oil Simulation Test (TEOST), SAE Paper 932837 (1993) and Stipanovic et al., "Base Oil and Additive Effects in the Thermo-Oxidation Engine Oil Simulation Test (TEOST)," SAE Paper 962038 (1996).

The apparatus includes an oxidation reactor and a deposition zone made up of a hollow depositor rod axially aligned within an outer tube. The temperature of the reactor and the depositor rod is independently controlled.

A lubricating oil composition under evaluation is mixed with 100 ppm of iron delivered as an iron naphthenate catalyst, then added to the reactor. The mixture is then heated to and held at 100° C. This sample is exposed to a gas stream of air, nitrous oxide, and water. Throughout the TEOST 33 test, the oil is pumped through the annulus between the depositor rod and the outside casing while the rod is cycled through a programmed temperature profile. Except for the initial temperature ramp from room temperature to 200° C. the temperature cycle was repeated 12 times. The total test duration lasts 114 minutes.

At the completion of the oxidation cycle, the oil is collected and filtered. The equipment is cleaned with solvent and that solvent is also filtered. The filter used in collecting the oil is dried and weighed to determine the filter deposits. The depositor rod is dried and weighed to determine the accumulation of deposits. The total deposit was the sum of the rod and filter deposits and reported in milligrams.

TEOST MHT-4

TEOST MHT4 (ASTM D7097) is designed to predict the deposit-forming tendencies of engine oil in the piston ring belt and upper piston crown area. Correlation has been shown between the TEOST MHT procedure and the TU3MH Peugeot engine test in deposit formation. This test determines the mass of deposit formed on a specially constructed test rod exposed to repetitive passage of 8.5 g of engine oil over the rod in a thin film under oxidative and catalytic conditions at 285° C. Deposit-forming tendencies of an engine oil under oxidative conditions are determined by circulating an oil-catalyst mixture comprising a small sample (8.4 g) of the oil and a very small (0.1 g) amount of an organo-metallic catalyst. This mixture is circulated for 24 hours in the TEOST MHT instrument over a special wire-wound depositor rod heated by electrical current to a controlled temperature of 285° C. at the hottest location on the rod. The rod is weighed before and after the test.

FTM 791A-3462 Panel Coker Test

The Panel Coker Test is a method for determining the relative stability of lubricants. It is often used to evaluate the deposit forming or lacquering tendency of the lubricants in contact with hot metal surfaces simulating deposit formation in engine cylinders and pistons. The test apparatus includes a rectangular stainless steel reservoir, inclined 25° from horizontal. The test panel (95 mm by 45 mm) is held in place by a heating element, which is fitted with thermocouple probes to control the temperature of the aluminum or steel test panel. A horizontal shaft, fitted with a series of tines, is positioned above the oil and is rotated at 1000 rpm. 300 ml of the lubricating oil under evaluation is placed in the Panel Coker apparatus and oil temperature is controlled at 100° C., while the test panel is heated to 300° C. During rotating of the shaft, the tines sweep through the test lubricant and lubricant droplets are thrown onto the heated test panel. The test panel is reweighed at the end of the test duration of 3 hours and the amount of deposit formed is determined. Weight gain of test panel and the amount of test lubricant consumed during the test are an indication of the lubricant's performance under high temperature conditions.

TABLE 2

| | Ex 1 | Ex 2 | Ex 3 | Ex 4 | Comp Ex 1 | Comp Ex 2 | Comp Ex 3 | Comp Ex 4 |
|---|---|---|---|---|---|---|---|---|
| TEOST T-33 Deposits (mg) | | | | | | | | |
| TEOST MHT-4 Deposits (mg) | | | | | | | | |
| Panel Coker Deposits (mg) | 4.5 | | 3.1 | 4.4 | | 17.5 | | |

It will be understood that various modifications may be made to the embodiments disclosed herein. Therefore, the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

The invention claimed is:

1. A lubricating oil composition comprising:

a) major amount of an oil of lubricating viscosity;

b) 0.00010 to 0.025 wt. % total alkaline earth metal concentration from one or more alkaline-earth metal detergents;

c) up to 0.30 wt. % of nitrogen from one or more nitrogen-containing dispersant; and d) up to about 0.10 wt % of zinc from zinc dithiophosphate;

wherein the lubricating oil composition has sulfur content up to 0.10 wt %, sulfated ash content of up to 0.30 wt %, and ratio of total nitrogen concentration to total alkaline earth metal concentration from the one or more alkaline earth metal detergent of about 20 or greater.

2. The lubricating oil composition of claim 1, wherein the lubricating oil composition has a total base number of about 5.5 mg KOH/g or less.

3. The lubricating oil composition of claim 1, wherein the lubricating oil composition has a viscosity index of about 200 or less.

4. The lubricating oil composition of claim 1, further comprising one or more antioxidants, wherein the total amount of antioxidants is 1.5-4 wt % based on total weight of the lubricating oil composition.

5. The lubricating oil composition of claim 1, further comprising one or more molybdenum containing compound.

6. The lubricating oil composition of claim 1, wherein the total alkaline earth metal concentration is from calcium or magnesium or both.

7. The lubricating oil composition of claim 1, wherein the one or more detergent is a sulfonate, a salicylate, or phenate.

8. A method of reducing deposit in an internal combustion engine comprising:

operating the internal combustion engine with a lubricating oil composition comprising:

a) major amount of an oil of lubricating viscosity;

b) 0.00010 to 0.025 wt. % total alkaline earth metal concentration from one or more alkaline earth metal detergent;

c) up to 0.30 wt. % of nitrogen from one or more nitrogen-containing dispersant; and d) up to about 0.10 wt % of zinc from zinc dithiophosphate;

wherein the lubricating oil composition has sulfur content of up to 0.10 wt %, sulfated ash content of up to 0.30 wt %, and ratio of total nitrogen concentration to total alkaline earth metal concentration from the one or more alkaline earth metal detergent of about 20 or greater.

9. The method of claim 8, wherein the lubricating oil composition has a total base number of about 5 mg KOH/g or less.

10. The method of claim 8, wherein the lubricating oil composition has a viscosity index of about 200 or less.

11. The method of claim 8, wherein the lubricating oil composition further comprises one or more antioxidants, wherein the total amount of antioxidants is 1.5-4 wt % based on total weight of the lubricating oil composition.

12. The method of claim 8, wherein the internal combustion engine is fueled with hydrocarbon fuel, hydrogen fuel, natural gas liquefied petroleum gas (LPG), compressed natural gas (CNG), or a mixture thereof.

13. The method of claim 8, wherein the lubricating oil composition further comprises one or more molybdenum containing compound.

14. The method of claim 8, wherein the total alkaline earth metal concentration is from calcium or magnesium or both.

15. The method of claim 8, wherein the one or more detergent is a sulfonate, a salicylate, or phenate.

* * * * *